United States Patent [19]

Wolnick et al.

[11] Patent Number: 4,809,608

[45] Date of Patent: Mar. 7, 1989

[54] INFRARED DRYER FOR PRINTING PRESSES

[76] Inventors: Kenneth Wolnick, 105 W. Milwaukee St.; William Decker, 122 S. River St., both of, Janesville, Wis. 53545

[21] Appl. No.: 116,476

[22] Filed: Nov. 3, 1987

[51] Int. Cl.[4] ..... F26B 3/30

[52] U.S. Cl. ..... 101/416.1; 101/426; 34/4; 34/41

[58] Field of Search ..... 101/416 R, 416 A, 426; 34/4, 41; 250/504 R, 495.1

[56] References Cited

U.S. PATENT DOCUMENTS

| | | | |
|---|---|---|---|
| 1,170,739 | 2/1916 | De Khotinsky | 34/41 X |
| 1,440,640 | 1/1923 | Smith | 101/416 A |
| 1,516,579 | 11/1924 | Sandforth | 101/416 A |
| 3,085,143 | 4/1963 | Antoncich | 34/41 X |
| 3,265,862 | 8/1966 | Smith, Jr. et al. | 34/4 X |
| 3,831,289 | 8/1974 | Knight | 34/4 |
| 3,877,152 | 4/1975 | Gorman | 34/4 X |
| 4,033,263 | 7/1977 | Richmond | 101/416 A |
| 4,434,562 | 3/1984 | Bubley et al. | 101/416 A X |
| 4,501,072 | 2/1985 | Jacobi, Jr. et al. | 34/416 A |
| 4,716,658 | 1/1988 | Jacobi, Jr. | 34/4 |

OTHER PUBLICATIONS

U.S. patent application Ser. No. 818,880 filed on Jan. 14, 1986 by David J. Van Tassel; and Kenneth Wolnick.

Reprint of article entitled, "The Heat is ON," *Quick Printing Magazine,* Feb. 1987, pp. 85–86.

Brochure published by Kennex Corporation entitled, "Infra-Red Puts the 'Quick' Back in Quick Printing."

*Primary Examiner*—Clifford D. Crowder

*Attorney, Agent, or Firm*—Lathrop & Clark

[57] ABSTRACT

An infrared dryer for printing presses has a main body (12), an ink shield (14), and a control box (16). The main body (12) has infrared lamps (30) positioned below a multiple-layer roof of sheet metal aluminum. The infrared lamps (30) are oriented toward the wet ink of printed matter at the delivery end of a printing press and the main body (12) is mounted within the printing press accordingly. The roof is comprised of an inside reflector (20) immediately above the infrared lamps (30) , a ligh box (22), and a direct space panel (b 24). These roof elements are separated by spacers (28) so that there are gaps between the elements. Fans (34) are employed to cool the main body (12) from the ehat generated by the infrared lamps (30). The fans (34) are mounted over a hole (36) in the direct spacer panel (24) and exhaust from the fans (34) goes through fan holes (38) and vent holes (48) in the other roof elements and through the gaps created by the spacers (28). Power is supplied to the infrared lamps (30) through bus bars (32) that are positioned in the gap created between the inside reflector (20) and light box (22) and is also cooled by the exhaust of the fans (34). The ink shield (14) is independent of the main body (12) and is positioned between the ink and water systems of the printing press and the main body (12) to act as a heat barrier to prevent the ink from thinning. A fan (106) is also mounted within the ink shield (14) to assist in cooling of the ink.

38 Claims, 6 Drawing Sheets

INFRARED DRYER FOR PRINTING PRESSES

FIELD OF THE INVENTION

This invention relates to means for drying ink on printed matter that has been produced by a printing press, so that the printed matter may be stacked, or run through the press a second time.

BACKGROUND OF THE INVENTION

In the printing industry, it is typical to stack the papers that have just been run off of the printing press. This often results in impressions of ink on the back of the next piece of paper in the stack, a problem known in the industry as "offset." The usual practice to avoid offset has been the use of a spray powder that is applied between the papers to be stacked, which serves to temporarily cushion wet ink on one delivered sheet from the next sheet. This cushioning prevents offset by separating the sheets long enough to allow the ink to "set up."

There are, however, drawbacks to using powder. Different powders are required on different prints, and it is necessary to keep the assorted powders in stock and exercise judgment in the selection of the proper powder for a particular job. Systems utilizing the spray powder fill the work area with dust, and this dust often becomes embedded on everything in the area. The powder has a tendency to collect on the workings of the press, as well as on equipment in other parts of the shop, causing mechanical breakdowns and jammings. The result in extra maintenance and repair costs, as well as lost profits in press down time. Systems employing powder may also be a potential health hazard in that the powder may end up being inhaled by the operator of the printing press.

The powder does not dry the ink, rather, it suspends the sheets to allow them to dry without causing offset. The subsequent drying is a slow process and it is typical to have numerous stacks around a print shop being allowed to dry before distribution to customers. Print jobs that involve multiple colors cannot be run quickly and cleanly because the powder becomes an intermediary between the paper and the second color ink.

To remedy the problems inherent with the use of spray powder, attempts have been made to introduce infrared dryers as a means of drying the ink. Though manufacturers have successfully incorporated infrared dryers in larger printing presses, problems have developed in attempting to adapt the dryers to smaller sheet-fed units. The biggest drawback is heat build-up, causing the potential for burns to operators, melted electrical connections, and fires within the press itself. Excessive heat may also thin the ink, resulting in an inferior product.

SUMMARY OF THE INVENTION

In accordance with the present invention, an infrared dryer has infrared lamps, bus bars that supply power to the lamps, direct and remote fans that produce convection cooling of the infrared dryer and the ink and water systems of the press, a layered roof over the lamps that further aids in the dissipation of heat, and a heat regulator that adjusts heat according to the speed of the press. The use of the infrared dryer of the present invention eliminates the need for powder sprays, and thereby avoids the problems associated with the use of the powder. The present invention incorporates features that alleviate dangers caused by excessive heat build-up in infrared dryers.

The infrared lamps used in the present invention are cylindrical, the ends forming electrical contacts that are inserted into slots in bus bars. Infrared bulbs are used that produce the infrared wave length with minimum heat. The power supply is connected to the end of the bus bars at a position remote from the infrared bulbs, so that the present invention has no electrical connections in the area of greatest heat concentration that could be melted under the heat of the lamps.

The infrared dryer of the invention employs a combination of features that reduce or dissipate heat build-up caused by the infrared lamps. The infrared dryer has fans that force air upon the areas surrounding the lamps to dissipate generated heat. One set of two fans is contained in the main body of the unit and is aimed at a reflector that is positioned directly above the infrared lamps. Another fan is framed within an ink shield that is independent of the main body of the infrared dryer, the ink shield acting as a barrier to protect the ink and water systems of the printing press from the heat produced by the infrared lamps, especially for long press runs. The ink shield and associated fan act to prevent the ink and water systems from heating to a point where the press ink is thinned, and also prevent ink from dripping on the main body of the infrared unit. A fan may also be optionally placed in a third, somewhat more remote location, directed so as to augment the fans that are positioned directly above the reflector.

The main body of the infrared dryer for printing presses has multiple layers of sheet metal above the infrared lamps, the reflector being that layer positioned directly above the lamps. The multiple layers of sheet metal are gapped by spacers, allowing air to flow between them. The gaps between the layers increase heat dissipation capabilities by either free or forced convection of the air, with the areas of forced convection being reached by the air blown by the fans. The layers may also act somewhat as fins, so that the body of the infrared dryer is also cooled somewhat by conduction. Aluminum is preferably used as the sheet metal for the multiple layers, rather than the commonly used stainless steel. Aluminum has a far greater coefficient of thermal conductivity, so that the heat is transferred more readily and trapped beneath the reflector. The transfer of heat away from the unit is sufficiently effective so that the operator will not be burned if he or she touches the highest layer.

In the present invention, the speed of the press preferably regulates the heat from the dryer so that a print job with heavy coverage is run more slowly through the press and will correspondingly pass more slowly under the dryer. The simpler print jobs run faster and therefore also pass under the dryer faster. In addition, the infrared dryer of the present invention features a control dial that allows for control by the operator of the infrared intensity that is radiated by the lamps. The control dial has a maximum setting that is pre-set for drying coated stock and print jobs with heavy solid coverage. The infrared intensity may be turned down via the control dial for jobs that do not require full infrared output. The use of the control dial saves energy as well as keeping the press cooler.

The present invention has a heat sensor that will automatically shut off the infrared dryer if the temperature of the dryer becomes too hot. The dryer of the present invention is coupled with safety devices of the printing press so that the press will shut down simultaneously with the infrared lamps. When the dryer cools down to an acceptable temperature, the press and the infrared lamps will again operate. The infrared dryer of the present invention also preferably turns off automatically with the press under normal conditions when the press is turned off by the operator for reasons other than heat build-up. The heat of the infrared dryer will therefore not be concentrated on a sheet of printed matter that might remain stationary under the lamp when the press is shut off.

The infrared dryer of the present invention has a two-position switch that enables the user to turn on the infrared lamps and the fans in tandem, or to turn on just the fans. The use of just the fans may be appropriate when printing carbonless paper.

Further objects, features, and advantages of the invention will be apparent from the following detailed description when taken in conjunction with the accompanying drawings.

DESCRIPTION OF THE PREFERRED EMBODIMENT

Figure 1:
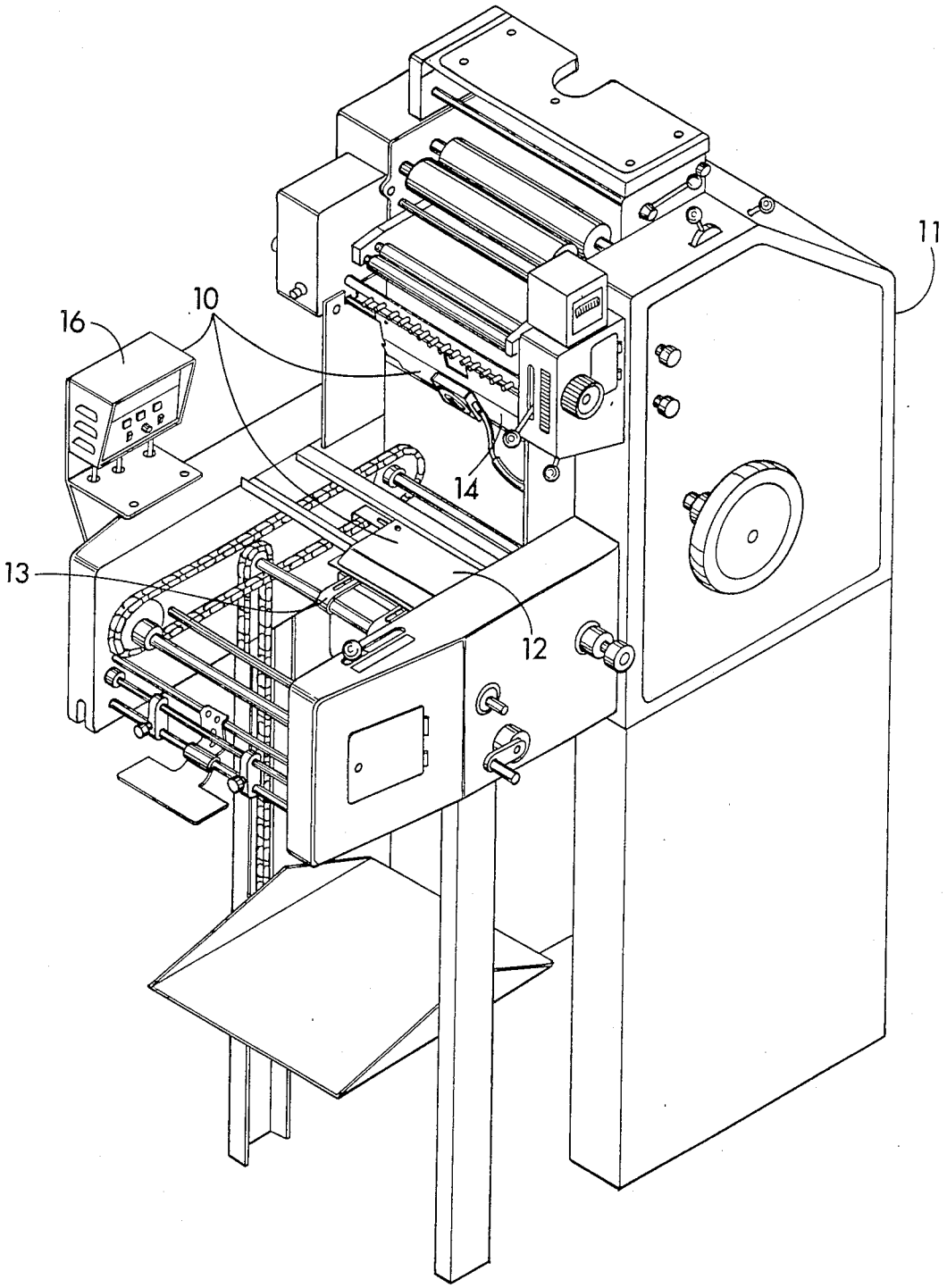
FIG. 1 is a perspective view of an exemplary printing press having the dryer of the invention installed thereon, illustrating the relative positions of the main body of the infrared dryer for printing presses, the ink shield, and the control box.
Figure 7:
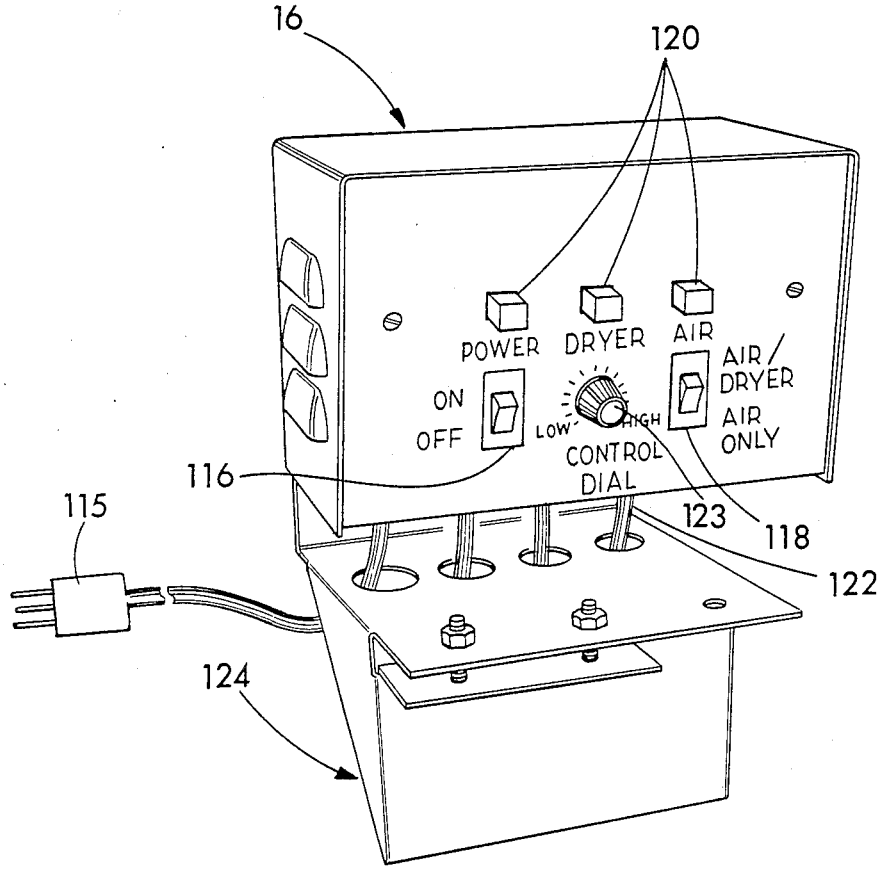
FIG. 7 is perspective view of the control box portion of the dryer of FIG. 1.

With reference to the drawings, an infrared dryer 10 for printing presses in accordance with the invention is shown for illustrative purposes mounted in position on a typical sheet fed press shown generally at 11 in FIG. 1. The dryer includes a main body shown at 12 in FIGS. 1, 2, 3 and 4, an ink shield 14 shown generally in FIGS. 1 and 5, and a control box 16 shown generally in FIGS. 1 and 7.

The main body 12 of the infrared dryer is positioned above the delivery end of the exemplary printing press 11, and is mounted upon brackets 13 that are tailored for mounting the main body 12 upon existing shafts, brackets, ledges, etc., of a particular model of the printing press 11. Printed matter having wet ink passes beneath the main body 12 and is dried from infrared radiation that is produced from the main body 12 and directed downward. An ink shield 14 is attached to existing shafts of the printing press and acts as a barrier to protect the ink and water systems of the printing press from the heat radiated from the main body 12. The main body 12 has a cooling system that integrates forced air convection to prevent excessive heat build-up. The control box 16 is typically mounted proximate to the main body 12 and controls power supply to both the main body 12 and ink shield 14. Details of these parts are explained more fully below.

The structure of the main body 12 is defined by a light cover 18, an inside reflector 20, a light box 22, a direct spacer panel 24, and an ink dryer cover 26. These elements of the main body 12 are generally rectangular in shape. Spacers 28 are placed so as to create gaps between the inside reflector 20 and the light box 22 and between the light box 22 and the direct spacer panel 24. Infrared lamps 30 are positioned directly below the inside reflector 20 and power is conveyed to the infrared lamps through bus bars 32. Two fans 34 are bolted to the direct spacer panel 24. Exhaust from the fans 34 travels through holes 36 in the direct spacer panel and holes 38 in the light box 22, and forced air cools the main body 12 of the infrared dryer by passing through the gaps created by the spacers 28.

The heat necessary to dry the ink on the sheets delivered from the printing press is generated by the infrared lamps 30. The present invention preferably has four cylindrical lamps 30 of 500 watts each that have translucent glass bulbs and electrical contacts 40 at both of the ends. An example of an infrared lamp with these specifications is a Sylvania Incandescent Quartz Lamp, Item No. 59850. A short uninsulated wire extends from each of the contacts 40 to screws 41 in the bus bars 32. The electrical contacts 40 of the preferred infrared bulb 30 are flattened at the ends so that they may be inserted into slots 42 of the bus bars 32. The infrared dryer has two L-shaped bus bars 32 that oppose one another, each one having four slots 42 to accommodate each end of the four infrared lamps 30. The bus bars 32 are composed of copper to provide low electrical resistivity and are electrically insulated from the elements of the main body 12 by three pairs of phenolic blocks 43, 44 and 45. The phenolic blocks 43 are held to the light box 22 by machine screws 46. The phenolic blocks 43 are then similarily attached by machine screws 47 to the bus bars 32, thereby insulating the bus bars 32 from the light cover 18 and the light box 22. Phenolic blocks 44 are attached to the inside of the bus bars 32 by one set of machine screws 51, and are attached to the flap 48 in the light box 22 by another set of machine screws (not shown in the drawings), thereby insulating the bus bars 32 from the light box 22. Phenolic blocks 45 are attached by machine screws 49 to the light cover 18 to insulate the light cover 18 from the bus bars 32.

The inside reflector 20 fits underneath and inside of the light box 22 and bus bars 32. The periphery of the inside reflector 20 has folds 50 along two parallel edges 52 and 53 and fold 54 on an edge 56 perpendicular to the parallel edges 52 and 53 that are acutely angled to further direct the radiations of the infrared lamps 30 generally downward. The folds 50 and 54 also act as a guard to prevent an operator from touching the bus bars 30, which may otherwise result in electrical shock to that operator. The inside reflector 20 has four notches 58 along each of the parallel edges 52 and 53 between the folds 50 that are large enough to accommodate the infrared lamps 30, and the notches 58 are aligned with the slots 42 of the bus bar 30 so that each of the infrared lamps 30 are positioned perpendicular to the edges 52 and 53. A first end of each of the infrared lamps 30 has its electrical contact 40 inserted into a slot 42 of the bus bar 32, the glass cylinder of the infrared lamp 30 passing through a corresponding notch 58 on parallel edge 52 and then through a directly opposing notch on the other parallel edge 53, and then being inserted into a corresponding slot on the opposing bus bar 32.

The fans 34 of the main body 12 are mounted to the direct spacer panel 24 by machine screws 60 that are inserted through the bottom of the light box 22, through spacers 28, through the bases 62 of the fans 34, and then are secured by lock washers and hex nuts. Another set of machine screws 64 fasten the inside reflector 20, the light box 22, and the direct spacer panel 24 together, these elements each also being separated by spacers 28. A power cord 72 having two leads 74 and a ground 76 supplies alternating electrical current to the infrared lamps 30, the leads 74 being connected to the ends of the bus bar 32. The ground 76 is attached to the light box cover 18 at the screw 78. The assembly of the inside reflector 20, the light box 22, and the direct spacer panel 24 are slid into the light cover 18 until the bus bars 32 abut against the phenolic block 45. The cross-section view of FIG. 4 best depicts how the light cover 18, inside reflector 20, light box 22, and direct spacer panel 24 fit together. The bus bar 32 is further shielded to prevent potential electrical shock of the operator by the underside 82 of the light cover 18 and by tabs 84 protruding from the inside reflector 20. The light cover 18 has apertures 86 between struts 88 through which the infrared radiation is directed toward the newly printed matter that is to be dried. The power cord 72 supplying electrical power to the infrared lamps 30 exits the light cover 18 through opening 90 and is clamped in place between fold 92 and bracket 94. The clamping of the power cord 72 between the fold 92 and bracket 94 also acts to hold the assembly of inside reflector 20, the light box 22, and the direct spacer panel 24 within the light cover 18.

The light cover 18, the inside reflector 20, the light box 22, the direct spacer panel 24, and the ink dryer cover 26 are all preferably stamped from 0.032 inch thick aluminum sheeet metal. Aluminum has excellent thermal conductivity (typically 137 BTU/hr FT °F.) and is far more thermally conductive than stainless steel (Type 304, typically 10 BTU/hr FT °F.) which is commonly used in infrared dryers. The preferred aluminum is designated by NEMA and ASTM as GPO-3 and is typically used for high voltage barriers, supports, and panels. The high value of thermal conductivity of the materials of the present invention promotes ease of heat transfer. The preferred fans 34 are Interfan Model PMO40-115-3B, having a die cast aluminum housing, plastic impeller, precision ball bearings, and terminal block. The fans 34 are supplied power through power cord 96 that separates into two plugs, one for each of the fans. The plugs mate with prongs in the body of the fan 34, the prongs not visible in the drawings as the plugs are shown inserted over the prongs. When the fans 34 are energized, exhaust from the fans blows through fan holes 36 in the direct spacer panel 24, fan holes 38 in the light box 22, and vent holes 98 in the inside reflector 20. The forced air from the fans flows through the gaps created by the spaces 28 between the inside reflector 20 and the light box 22, and through the gaps created by the spacers 28 between the light box 22 and direct spacer panel 24. The main body 12 is therefore cooled by the air that is forced between and against the different parts. The main body 12 may also be cooled somewhat by free convection at those areas where the exhaust of the fans does not reach, or that are only marginally reached. The different layers of the main body 12, i.e. the light cover 18, the inside reflector 20, the light box 22, and the direct spacer panel 24, also act somewhat like fins that cool the main body 12 by condution. Though the temperature in the areas immediately around the infrared lamps 30 may be in the area of 600° F. when the infrared dryer is being used, the effect of the combined cooling means employed in the infrared dryer for printing presses is that the direct spacer panel 24 approaches the ambient room temperature and may be safely touched by the operator of the printing press. The ink dryer cover 26 has aluminum mounting pegs 100 that are attached to the ink dryer cover by screws 101 and are correspondingly inserted into holes 102 in the frames of the fan 34. The ink dryer cover 26 is a guard against foreign objects falling into the fan 34, and may also act as another layer that is cooler than the direct spacer panel 24.

The bus bars 32 are made from copper stock. Copper, like aluminum, has a high value of thermal conductivity (typically 230 BTU/hr FT °F.) and will also serve to be an efficient transferor of heat. The bus bars 32 and the slots 42 that act as sockets for the infrared lamps 30 are exposed to air, and subject to the same cooling effects as the rest of the main body 12, as discussed above. There are no electrical insulators in the area of highest heat concentration, and therefore the potential for melted connections or electrical fires is significantly lessened.

Figure 5:
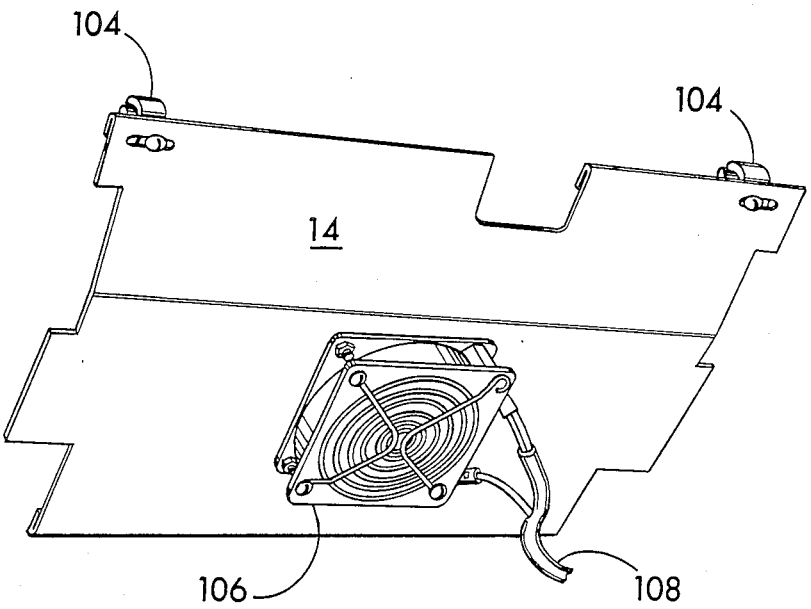
FIG. 5 is bottom perspective view of the ink shield portion of the infrared dryer.
Figure 6:
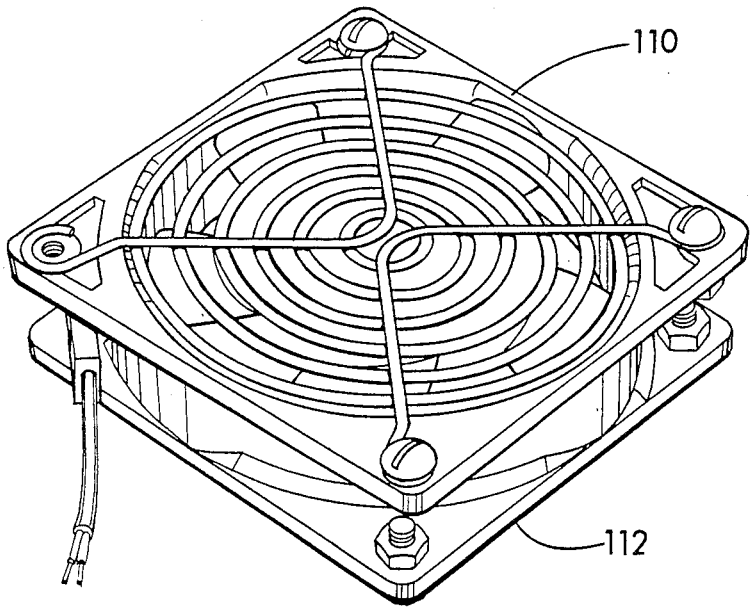
FIG. 6 is a top perspective view of the remote fan portion of the dryer of FIG. 1.

The infrared dryer for printing presses of the present invention includes an ink shield 14 that is independent of the main body 12 and is shown in FIG. 5. The ink shield 14 is preferably composed of 24 gauge stainless steel, the edges of the periphery being folded over to form lips to eliminate sharp edges. The stainless is preferably AISI Type No. 304 and SAE No. 30304. The ink shield 14 has clips 104 and a centrally located hole not visible in FIG. 5 over which a fan 106 is mounted. The ink shield 14 acts as a barrier to protect the ink and water systems of the printing press from the heat produced by the infrared lamps 30 that may otherwise thin the ink and produce an inferior product. One end of the ink shield 14 has the clips 104 that attach to the bar that is typically under the ink tray of the printing press; the other end rests on the press support bar under the ink rollers. Power is supplied to the fan 106 through a power cord 108, and the fan 106 directs air at the ink and water systems of the printing press when energized. The ink shield 14 also acts to prevent ink from dripping on the main body 12 of the infrared dryer and may be easily removed for cleaning of the printing press.

An alternative embodiment to the ink shield 14 is employed in those instances where the ink shield 14 is not compatible with attachment to the bar surrounding the ink trays of the printing press, or in instances where the layout of the press is such that there is no danger of the ink thinning from heat that is generated from the infrared lamps 30. In such cases, the alternative embodiment consists simply of a remote fan 110 without the surrounding ink shield 14 that is positioned above the main body 12 so as to augment the cooling effect of the fans 34 that are mounted on the direct spacer panel 24. The remote fan 110 is typically mounted on a cage cover that is common at the delivery end of printing presses. The remote fan 110 is bolted through its base 112 through the cage with washers and nuts from the underside of the cage. The remote fan 110 is mounted as close to the center of the main body 12 as possible.

The infrared dryer 10 of the present invention incorporates a heat sensor 111 that is wired back to the control box 16 so that the infrared lamps 30 will automatically be turned off if the temperature in the area of the light box exceeds a safe level. Cord 113 leads to the control box 16 from the heat sensor 111, where it is attached to the heat sensor by leads 114. The heat sensor is attached to the flap 48 in the light box 22. This automatic shut-off of the lamps 30 in conditions of excessive heat is coupled with press safety devices so that the press 11 will shut down in coordination with the lamps 30 under circumstances of excessive heat. When the temperature in the areea of the light box 22 returns to an acceptable level, both the infrared lamps 30 and printing press 11 will resume operation.

The present invention is preferably powered by a 20 ampere 110 volt service that plugs into a standard electrical outlet through power cord 115, the power cord 115 being received by the control box 16 of FIG. 5. The control box 16 is mounted to an accessible part of the printing press 11 upon bracket 124. Power cord 72 leading from the bus bars 32, power cord 96 leading from the fans 34, power cord 108 leading from the fan 106 of the ink shield (or the remote fan), and cord 113 leading from the heat sensor 111 are all fed into the control box 16 and clamped into place through holes in the bottom of the control box 16, not visible in FIG. 5. These leads are connected to an internal terminal board in the control box 16. The control box 16 has an on/off power switch 116, and a two-position switch 118 that turns the fans (34, 106 and 110) and infrared lamps 30 on in tandem, or that turns only the fans on. The printing press 11 can be run under the main body 12 of the infrared dryer 10 with the fans on and without infrared radiation in the instance when carbonless paper, for example, is being run. The control box 16 has indicator lights 120 that represent whether the infrared dryer of the present invention has power applied to it, whether the dryer is on, and whether the fans are on. More than one of these indicator lights may be on at one time, representing a combination of these modes. A remote power cord 122 with two leads extends out of the control box 16 to the electrical relay box of the printing press. One lead is attached to the positive press motor relay and the other is attached to the neutral blower motor relay so that the infrared lamps 30 operate only when the press motor and blower motor are running.

The amount of heat generated by the infrared dryer is determined by the speed of the press and by a control dial 123 of the control box 16. The speed of the press 11 regulates the amount of time that the printed matter is exposed to the heat of the infrared lamps 30. The printed matter that requires heavy ink coverage is ordinarily run through the press at a slower rate of speed, and is therefore subject to the radiation of the infrared lamps 30 for a longer period of time than the shorter runs that require lighter coverage of ink. The control dial 123 allows for a range of settings, the high end representing an intensity level of infrared radiation that is pre-set for drying coated stock and print jobs that have heavy solid coverage. The control dial 123 may be turned down for print jobs that do not require full infrared output.

Figure 2:
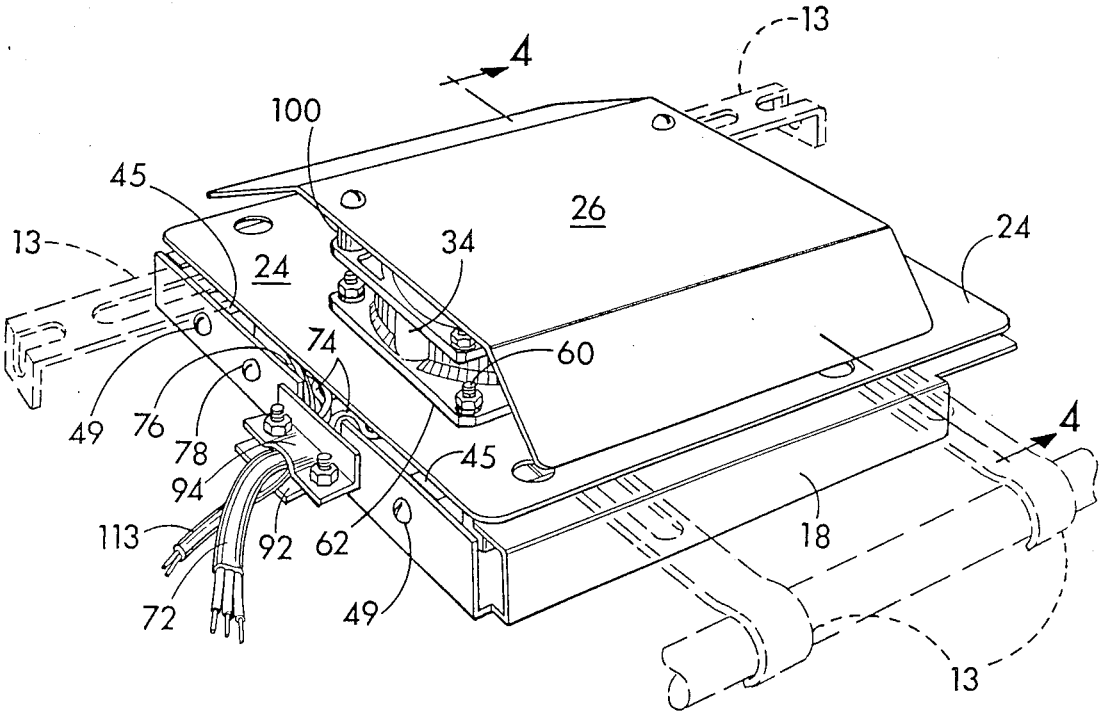
FIG. 2 is a perspective view of the main body of the infrared dryer for printing presses of the present invention.
Figure 4:
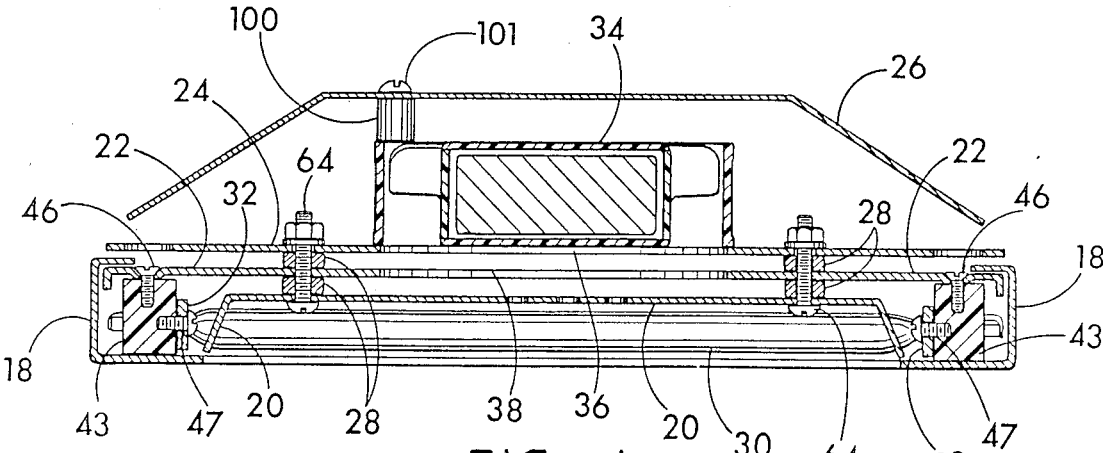
FIG. 4 is a cross-section taken along line 4—4 of FIG. 2.
Figure 3:
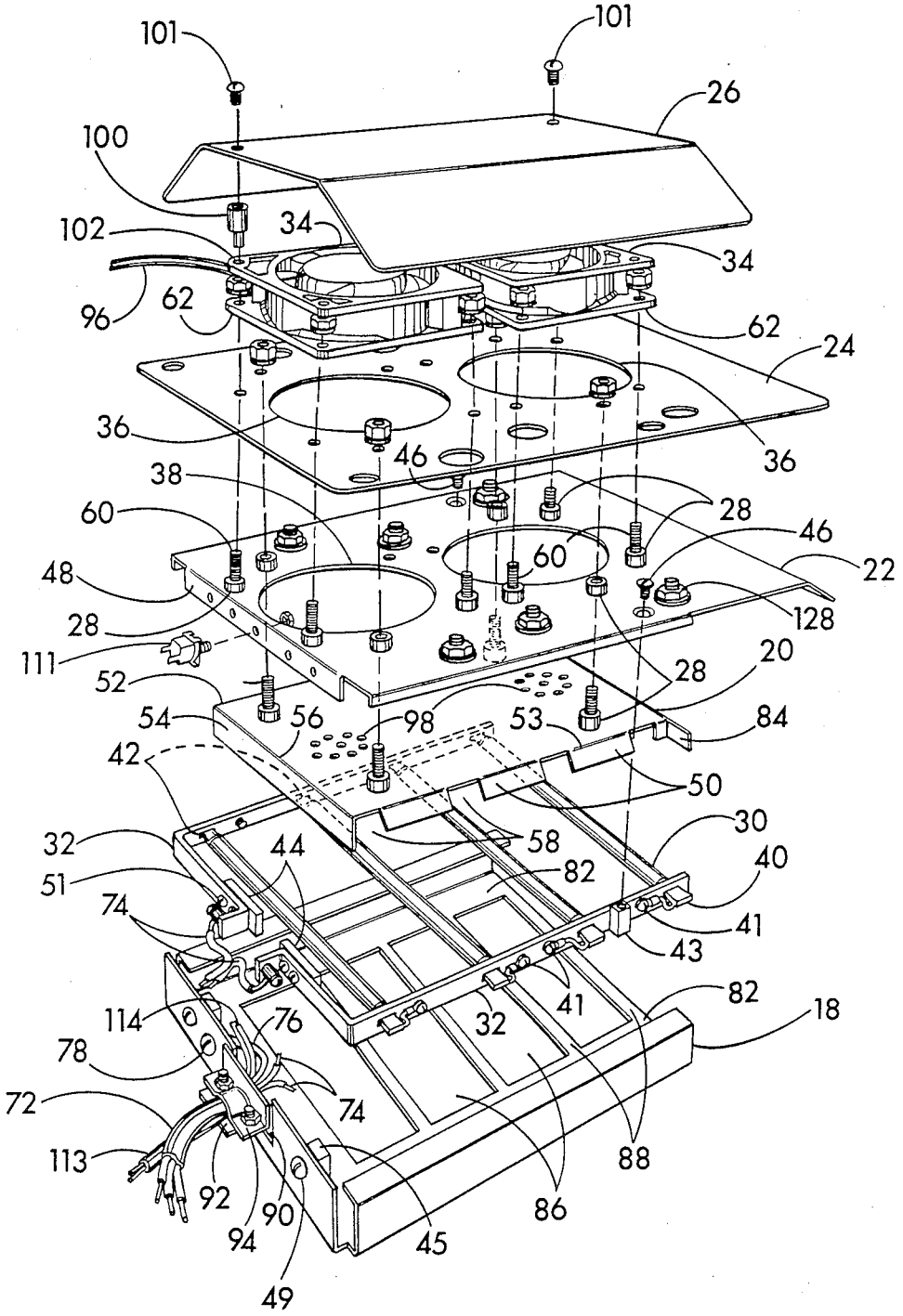
FIG. 3 is an exploded perspective view of the main body of the infrared dryer showing the disassembled parts in relationship to one another.
Figure 8:
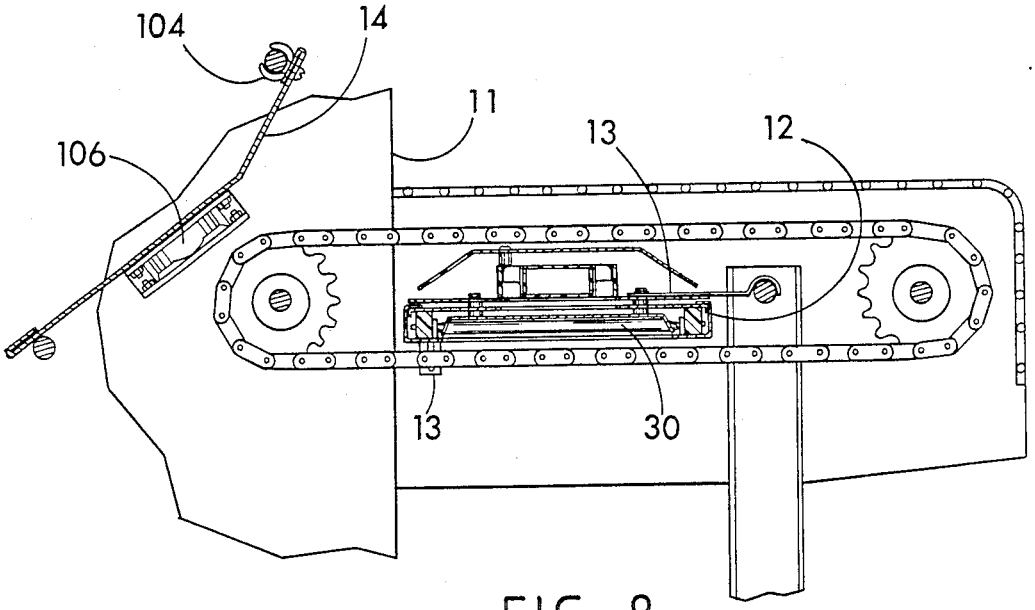
FIG. 8 is a cross-section of a printing press having the dryer of the invention installed thereon, showing the relative positions of the main body of the infrared dryer and the ink shield.

FIG. 8 shows the main body 12, the ink shield 14, and the remote fan 106 installed on the printing press to show their relative positions. The different parts, and the main body 12 especially, may require different mounting brackets in order to be compatible with the many different brands of printing presses. The brackets 13 as depicted in FIGS. 1, 2, and 8 that show attachment of the main body 12 to the printing press 11 are meant to be exemplary. The brackets 13 are attached to the main body 12 at the screws 128. Some custom tailoring of parts may also be necessary in order that these parts fit.

Figure 9:
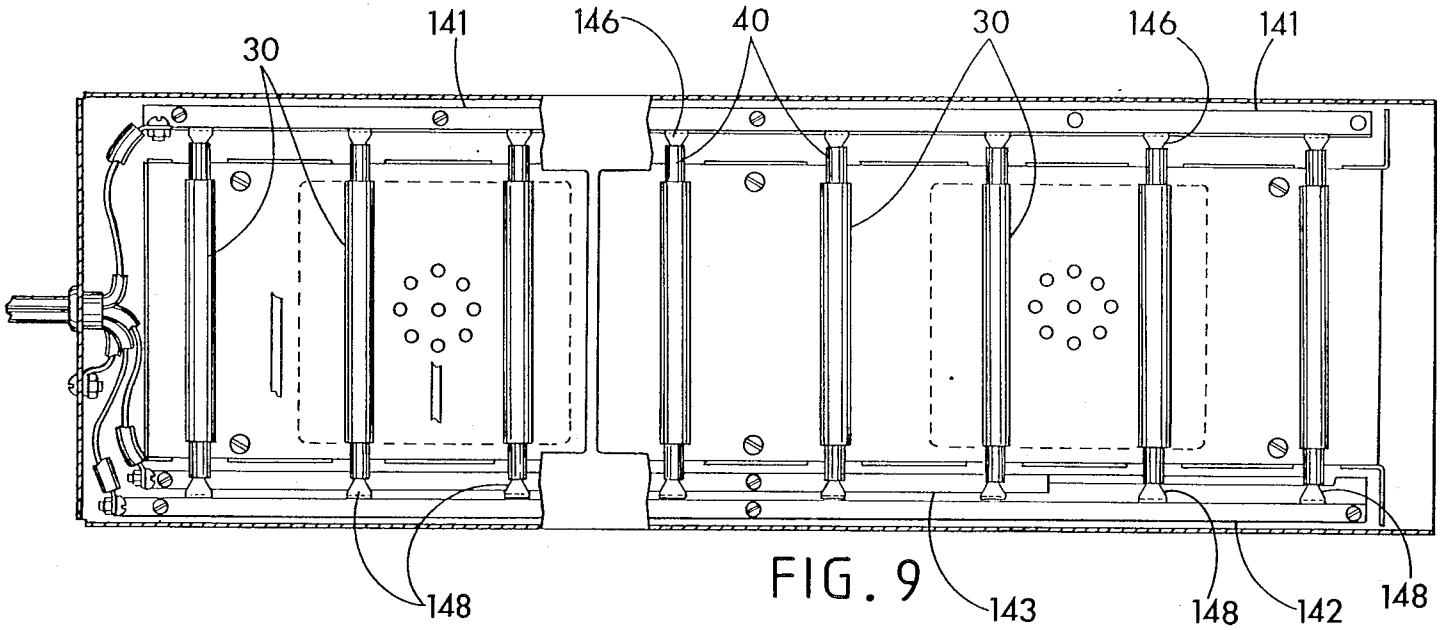
FIG. 9 is a bottom view of the main body of the infrared dryer, disclosing an alternative embodiment for the bus bars.
Figure 10:
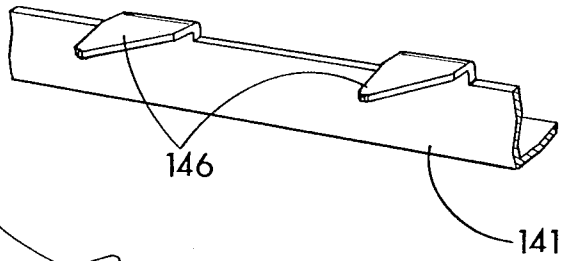
FIG. 10 is a perspective view of the alternative embodiment of the bus bars.
Figure 10:
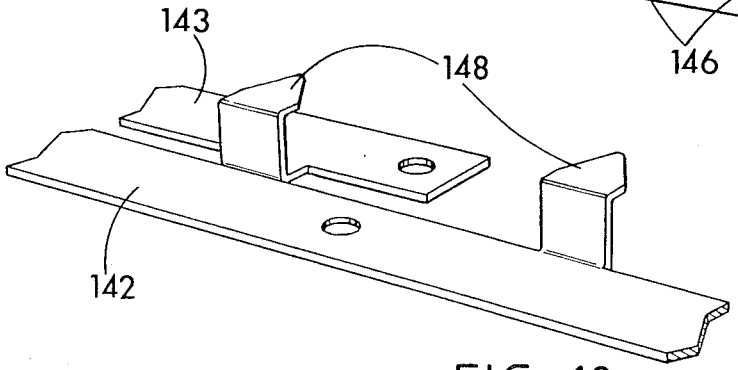

FIGS. 9 and 10 depict an alternative embodiment of the infrared dryer for printing presses, featuring a different design for the bus bars. Alternate bus bar 141 opposes alternate bus bars 142 and 143. The bus bar 141 has integral fixed connectors 146 that mate with the electrical contacts 40 at one end of the infrared lamps 30. The electrical contacts 40 at the second end of the infrared lamps 30 mate with a spring contactor 148 that is an integral part of either bus bar 142 or 143, each spring contactor 148 directly opposing a corresponding fixed connector 146. Each of the infrared lamps 30 is therefore held in place by being spring loaded between a fixed connector 144 and spring contactor 146, the fixed connector 144 and spring contactor 146 also conveying electricity through them to power the infrared lamps. The bus bars 141, 142 and 143 are preferably composed of phosphorus bronze spring stock.

It is understood that the invention is not confined to the particular construction and arrangement of parts herein illustrated and described, but embraces such modified forms thereof as come within the scope of the following claims.

What is claimed is:

1. An infrared dryer that dries the ink on printed matter delivered from printing presses, comprising:

(a) means for radiating infrared upon wet ink that has been applied to printed matter that is placed in the vicinity of the means for radiating, (b) a heat conducting roof that is positioned above the means for radiating infrared, the roof being composed of multiple layers of sheet metal, at least one of the layers having holes and the layers being gapped so that the air may pass through the holes and flow between the layers, and (c) means for forcing air downwardly toward the printed matter through the holes in the layers where it can flow outwardly through the gaps between the layers to cool the surfaces of the roof.

2. The infrared dryer of claim 1 wherein the means for radiating infrared is at least one infrared lamp.

3. The infrared dryer of claim 1 wherein the means for forcing air through the holes in the layers and through the gaps is at least one fan.

4. The infrared dryer of claim 3 wherein the fan is mounted on one of the layers of sheet metal.

5. The infrared dryer of claim 1 wherein the gaps between each of the different layers of the roof are created by spacers that are fastened between the individual layers.

6. The infrared dryer of claim 5 wherein the spacers are heat insulators.

7. The infrared dryer of claim 1 wherein the layer closest to the means for radiating forms a reflector which has a reflective surface.

8. The infrared dryer of claim 1 wherein the layers of the roof are composed of aluminum.

9. The infrared dryer of claim 2 wherein there are a plurality of infrared lamps and each lamp is generally cylindrical in shape and has electrical contacts at both ends and wherein the infrared dryer further comprises:

(a) two electrically conducting bus bars, the lamps being positioned between the bus bars with the electrical contacts of the lamps in electrical contact with the bus bars, and (b) a power cord having two leads, wherein each of the two leads is attached to a respective bus bar.

10. The infrared dryer of claim 9 wherein the electrical contacts of the lamps are flattened and each of the bus bars has a slot to accommodate the flattened ends of the lamps.

11. The infrared dryer of claim 9 wherein the lamps are secured between the bus bars by spring loading the lamps between the bus bars.

12. The infrared dryer of claim 9 wherein the bus bars are positioned between two of the layers of the roof and are exposed to the air that is forced between the gaps.

13. The infrared dryer of claim 9 further comprising a means for electrically insulating the bus bars from the layers of the roof.

14. The infrared dryer of claim 13 wherein the means for electrically insulating are phenolic blocks.

15. The infrared dryer of claim 9 wherein the layers of the roof surrounding the bus bars have folds along their peripheries to cover the bus bars and thereby prevent the operator from touching the bus bars and experiencing electrical shock.

16. The infrared dryer of claim 9 wherein the bus bars are composed of copper.

17. The infrared dryer of claim 9 wherein the bus bars are composed of phosphorus bronze.

18. The infrared dryer of claim 1 further comprising a barrier that is inserted between the ink and water systems of the printing press and the assembly of the roof and the lamp.

19. The infrared dryer of claim 18 further comprising a fan that is mounted in the barrier, the exhaust of the fan being directed toward the ink and water systems to keep them cool.

20. The infrared dryer of claim 1 wherein a remote fan independent of the assembly of the roof and the lamp is mounted so as to direct exhaust at said assembly and augment the means for forcing air.

21. The infrared dryer of claim 1 further comprising a means for controlling that is wired with a switch having at least two positions, one position that has a setting to energize the means for forcing air, and a second setting for energizing the means for radiating and the means for forcing air simultaneously.

22. The infrared dryer of claim 1 further comprising a means for controlling that automatically shuts off the means for radiating when the printing press is shut off.

23. The infrared dryer of claim 1 further comprising a means for controlling that automatically shuts off the means for radiating when the infrared dryer reaches a pre-determined temperature.

24. An infrared dryer that dries the ink on printed matter delivered from printing presses, comprising:

(a) plural parallel infrared lamps having electrical contacts at their two ends and arranged for radiating infrared upon wet ink that has been applied to printed matter that is placed in the vicinity of the lamps, (b) two parallel electrically conducting bus bars each formed of solid metal, the lamps being in direct contact at their ends with and engaged between the bus bars with the electrical contacts of the lamps forming electrical contact with the bus bars, (c) a power cord having two leads, wherein each of the two leads is attached to a respective bus bar, and (d) a reflector mounted above the lamps to reflect infrared toward the printed matter.

25. The infrared dryer of claim 24 wherein the infrared lamps are generally cylindrical in shape.

26. The infrared dryer of claim 24 wherein the electrical contacts of the lamps are flattened and each of the bus bars has a slot to accommodate the flattened ends of the lamps.

27. The infrared dryer of claim 24 wherein the lamps are secured between the bus bars by spring loading the lamps between the bus bars.

28. The infrared dryer of claim 24 wherein the bus bars are exposed to air to cool the bus bars.

29. The infrared dryer of claim 24 further comprising a means for electrically insulating the bus bars from the body of the infrared dryer.

30. The infrared dryer of claim 29 wherein the means for electrically insulating are phenolic blocks.

31. The infrared dryer of claim 24 wherein the bus bars are composed of copper.

32. The infrared dryer of claim 24 wherein the bus bars are composed of phosphorus bronze.

33. The infrared dryer of claim 24 further comprising a barrier that is inserted between the ink and water systems of the printing press and the assembly of the roof and the lamp.

34. The infrared dryer of claim 24 further comprising a means for controlling that automatically shuts off the means for radiating when the printing press is shut off.

35. The infrared dryer of claim 24 further comprising a means for controlling that automatically shuts off the means for radiating when the infrared dryer reaches a pre-determined temperature.

36. A method of drying ink on printed matter delivered from printing presses, comprising the steps of:

(a) positioning printed matter having wet ink in the vicinity of an infrared dryer that is a source of infrared radiation, (b) exposing the wet ink of the printed matter to infrared radiation which is reflected by a reflecting layer of sheet metal, and (c) cooling the reflecting layer by transferring heat in the reflecting layer generated by the source of infrared radiation through successive layers of sheet metal that have gaps between them and holes in the layers by blowing air downwardly through the holes in the layers so that air flows outwardly through the gaps between the layers.

37. The method of claim 36 further comprising the step of controlling the source of infrared radiation so as to automatically shut off the infrared radiation when the printing press shuts off.

38. The method of claim 36 further comprising the step of controlling the source of infrared radiation so as to automatically shut off the infrared radiation when the infrared dryer reaches a pre-determined temperature.

* * * * *